US007845896B2

(12) United States Patent
Bitter et al.

(10) Patent No.: US 7,845,896 B2
(45) Date of Patent: Dec. 7, 2010

(54) LOADER

(75) Inventors: Marcus Bitter, Mannheim (DE); Richard Tudor, Zweibrücken (DE)

(73) Assignee: Deere & Company, Moline, IL (US)

( * ) Notice: Subject to any disclaimer, the term of this patent is extended or adjusted under 35 U.S.C. 154(b) by 656 days.

(21) Appl. No.: 11/850,910

(22) Filed: Sep. 6, 2007

(65) Prior Publication Data

US 2008/0073155 A1 Mar. 27, 2008

(30) Foreign Application Priority Data

Sep. 8, 2006 (DE) ..... 10 2006 042 372

(51) Int. Cl.
*E02F 3/38* (2006.01)

(52) U.S. Cl. ..... 414/699; 60/459

(58) Field of Classification Search ..... 414/699, 414/680, 718, 728; 60/459, 463; 280/754
See application file for complete search history.

(56) References Cited

U.S. PATENT DOCUMENTS

| | | | | |
|---|---|---|---|---|
| 4,042,135 | A * | 8/1977 | Pugh et al. | 414/718 |
| 2006/0090460 | A1 * | 5/2006 | Ma et al. | 60/459 |
| 2008/0302099 | A1 * | 12/2008 | Vigholm et al. | 60/459 |

FOREIGN PATENT DOCUMENTS

| | | |
|---|---|---|
| DE | 19853523 | 3/2000 |
| EP | 0580007 | 1/1994 |
| EP | 1496009 | 1/2005 |
| EP | 1612184 | 1/2006 |
| EP | 1762535 | 3/2007 |
| WO | WO 2004/007339 | 1/2004 |

OTHER PUBLICATIONS

European Search Report, May 14, 2009, 7 Pages.

* cited by examiner

*Primary Examiner*—Donald Underwood

(57) ABSTRACT

A loader includes a hydraulically operated extension arm, a load sensor for monitoring the load condition on the loader and a hydraulic arrangement for actuation of the extension arm and/or an implement attached to the extension arm. The hydraulic arrangement exhibits at least one hydraulic cylinder with one supply line on the piston rod side and one supply line on the piston side. At least one mechanically switchable control device is coupled between a source of fluid pressure and a hydraulic tank, on the one hand, and the supply lines on the other hand. An electronic control unit is connected for effecting operation of a restricting device coupled between the supply lines in response to a load signal received from the load sensor so as to achieve a slowed-down actuation of the hydraulic cylinder in conjunction with the on set of a critical load condition. Thus, a restriction of a volumetric flow is achieved in at least one of the supply line on the piston rod side or the supply line on the piston side of the hydraulic cylinder.

7 Claims, 4 Drawing Sheets

LOADER

FIELD OF THE INVENTION

This invention relates to a loader with a hydraulically actuated extension arm, a sensor for monitoring the load condition on the loader and a hydraulic arrangement for actuation of the extension arm and/or an implement attached to the extension arm, the hydraulic arrangement exhibiting at least one hydraulic cylinder with a first supply line on the piston rod side and a second supply line on the piston side, at least one mechanically switchable control device for controlling the at least one hydraulic cylinder, a hydraulic source, a hydraulic tank and an electronic control unit.

BACKGROUND OF THE INVENTION

In the area of loaders/such as loading vehicles or telescopic loaders and the like, systems are previously disclosed which protect the vehicle from getting into an unsafe load condition. Unsafe load conditions arise, for example, when the vehicle overturns over the front axle as the result of a forward shift in the center of mass, in these systems, the hydraulic functions are braked and are brought to a halt as soon as a sensor detects that the vehicle is threatening to tip. Once the hydraulic actuators have been stopped, the only functions that can still be operated are those which bring the vehicle back into a safe condition, for example raising the extension arm, tilting back the implement or the load and retracting the extension arm.

In systems of this kind, it is sensible not to arrest the movements of an extension arm too abruptly, as this can lead to overturning of the vehicle due to the Inertia of the load and the extension arm. It is sensible to slow down the functions progressively the closer the vehicle approaches to a critical operating condition or load condition.

WO 2004/007339 A1 discloses a system of this kind. Here a tipping moment acting on the vehicle is detected by a sensor and Is transmitted to an electronic control unit. Also provided are a number of hydraulic cylinders for the lifting, lowering and telescoping of a telescopic extension arm as well as the electro-hydraulic actuation of the hydraulic cylinders. The system provides for the hydraulic functions for operating the hydraulic cylinders to be slowed down as a set threshold value for the tipping moment is approached, before the hydraulic cylinders come to a complete standstill. In this case, for example, the load signal is processed electronically and the possibilities for operation by the user are reduced and/or operation is prevented. The more advanced the technology, for example by the use of electronic control units, the easier is the intervention by means of the electronics.

For systems with mechanically controlled control devices, in which the valve gates of the control device are actuated via Bowden cables or levers, the characterizing features disclosed in WO 2004/007339 A1 do not find an application, because it is not possible to intervene in a controlled manner by such simple means in the functions that are executed mechanically by the operator, due to the absence of suitable electronics.

SUMMARY OF THE INVENTION

The underlying object of the invention is to propose a loader of the kind Indicated by way of introduction, by which the aforementioned disadvantages are overcome.

According to the invention, a loader of the kind mentioned byway of introduction is configured in such a way that means for restricting the volumetric flow rate are provided between the control device and the hydraulic cylinder, by which means, depending on a sensor signal supplied by the sensor, a volumetric flow can be restricted in at least one of the supply line on the piston rod side or the supply line on the piston side of the hydraulic cylinder. The operability of the hydraulic cylinder actuated via a mechanically controlled control device is influenced via the means for varying the volumetric flow in such a way that a volumetric flow rate for the hydraulic fluid flowing into one of the two chambers of the hydraulic cylinder is restricted and/or reduced, so that the speed at which a specific quantity of hydraulic fluid flows into one of the chambers is restricted and/or reduced, and the movement of the hydraulic cylinder and/or piston is ultimately slowed down in this way. The volumetric flow of the hydraulic fluid flowing into the chamber of the hydraulic cylinder is reduced to an increasing extent in this way, the closer a critical value for the load condition is approached, which value is set by the electronic control unit. In order to prevent an operator from being able to bring the vehicle into an unsafe condition, which might ultimately result in over turning of the vehicle, the functions of the hydraulic cylinder are initially slowed down in this way and are then finally brought completely to a halt.

The means for restricting the volumetric flow rate preferably consists of at least one electro-hydraulic overpressure valve capable of actuation by the electronic control unit and is arranged in a connecting line extending between the supply line on the piston rod side and the supply line on the piston side. The electro-hydraulic overpressure valve can be opened progressively depending on the load signal supplied by the sensor and/or the overload signal. The closer one approaches to the pre-set threshold value, the greater is the threat of the vehicle overturning, and the less the overpressure valve is adjusted and/or the more the overpressure valve is opened.

A check valve is preferably provided in the connecting line, so that the hydraulic fluid is able to flow through the overpressure valve in only one direction from the supply line on the piston rod side into the supply line on the piston side, or vice versa. It Is also conceivable, however, for a check valve of this kind to be integrated already in the overpressure valve, in any case, the hydraulic cylinder can be actuated in this way in the opposite direction of movement from that which is customary. It is naturally also conceivable for a number of hydraulic cylinders to be capable of being used for the control of the hydraulic cylinders. In the event that a number of control devices and a number of hydraulic cylinders are used, a number of electro-hydraulic over pressure valves can be used, which are adjusted by the electronic control unit depending on the sensor signal.

It is thus possible to restrict the movements of the extension arm in such a way that the vehicle is not able to get Into a dangerous operating condition, in conjunction with which the operator, in addition to the warning signals which are generated anyway in the cab of the loader, will be made aware of the fact that, in spite of the adjustment default, the extension arm is moving increasingly slowly until it comes to a halt.

In another embodiment, the means for restricting the volumetric flow also comprise at least one electro-hydraulic overpressure valve capable of being actuated by the electronic control unit, although the means are arranged in a discharge line branching from the supply line on the piston rod side or the supply line on the piston side of to the hydraulic tank. In this way, the hydraulic fluid branched through the overpressure valve from the supply line on the piston rod side or the supply line on the piston side is conveyed directly into the hydraulic tank, and not into the supply line on the piston side or the supply line on the piston rod side. This also permits smaller threshold pressure values to be set, since the pressure in the previous illustrative embodiment (connecting line) acting in the corresponding other supply line acts against the actual opening pressure, which has a negative effect on the sensitivity and/or on the response characteristic of the overpressure valve. This is not the case with an overpressure valve, which is arranged in a discharge line leading directly into the hydraulic tank.

The loader is preferably configured as a telescopic loader, in conjunction with which the extension arm is capable of being varied via a first hydraulic cylinder in respect of Its angle of attack and via a second hydraulic cylinder in respect of its length, in conjunction with which a third hydraulic cylinder may be provided, with which an Implement arranged on the extension arm is capable of being caused to pivot. Thus, for example, the tilting back of a loading shovel filled with material can also lessen a critical load condition, but without the extension arm being moved. In any case, the overpressure valves arranged in the control pressure lines of the control devices provide for a slow execution of the movements determined by the operating person, so that no disruptive inertia mass effects of the load material or of the extension arm occur, which can then provoke overturning of the loader in the vicinity of the threshold value range.

In another embodiment the loader comprises a front loader, in which the extension arm is configured as the load arm of the front loader, which is capable of being varied via a first or a first and a second hydraulic cylinder in respect of its angle of attack. A third hydraulic cylinder can be provided by means of which an implement provided on the extension arm, for example a loading shovel or a loading for, is capable of being caused to pivot.

Of course, ail other customary loading implements, for example buckets, bale grabbers, etc., are capable of being used both with the telescopic loader and with the loader equipped with the front loader.

The sensor is preferably configured and arranged in such a way that a critical load condition on the loader is detectable. The sensor can be arranged on an axle of the vehicle, for example, and can indicate a critical load condition in the event of a correspondingly high, unbalanced load. Strain gauges or force transducers, for example, can find an application in this case. It is also conceivable to position the sensor at some other suitable pint and, fore example, to define the inclination of a vehicle frame in relation to the vehicle axis as the critical load condition quantity.

The invention and further advantages and advantageous further developments and embodiments of the invention are described in more detail and explained below with reference to the drawing which depicts illustrative embodiments of the invention.

DESCRIPTION OF THE PREFERRED EMBODIMENT

Figure 1:
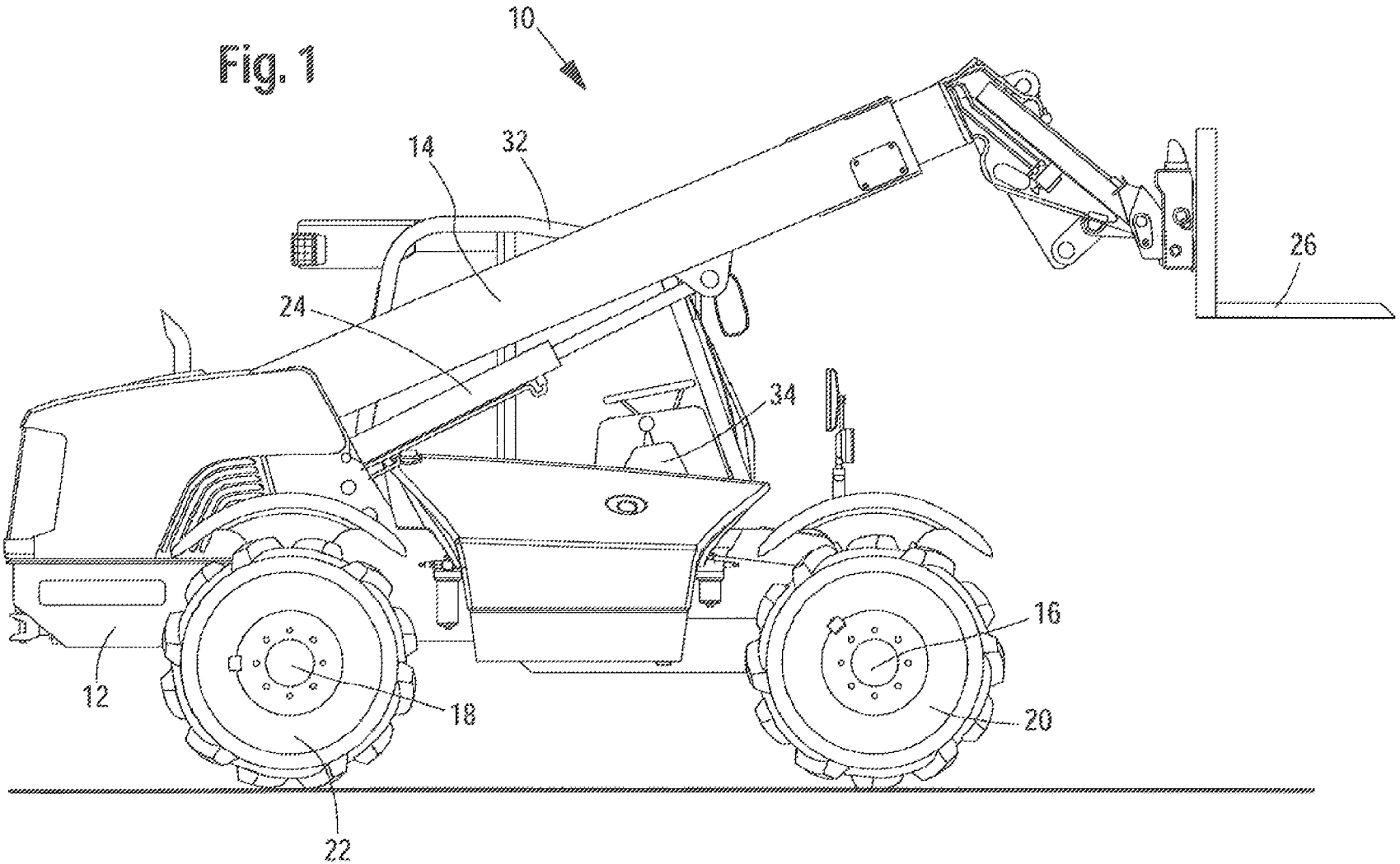
FIG. 1 is a schematic right side view of a loader configured as a telescopic loader having a hydraulic arrangement according to FIG. 2 or 3.

Illustrated in FIG. 1 is a loader 10 in the form of a telescopic loader. The telescopic loader 10 exhibits a frame 12, to which an extension arm 14 is linked The frame 12 is supported by a front axle 16 and by a rear axle 18 with corresponding front and rear wheels 20 and 22, respectively.

The extension arm 14 is configured as a telescopic extension arm and is adjustably linked via a hydraulic cylinder 24 in respect of its angle of attack in relation to the frame 12. A second hydraulic cylinder (not illustrated) is arranged in the interior of the extension arm 14 and permits the retraction and/or extension (telescoping) of the extension arm. A third hydraulic cylinder (not illustrated) is arranged on the free end of the extension arm 14 in the interior and permits the oscillation and/or tilting of a loading implement 26.

Figure 2:
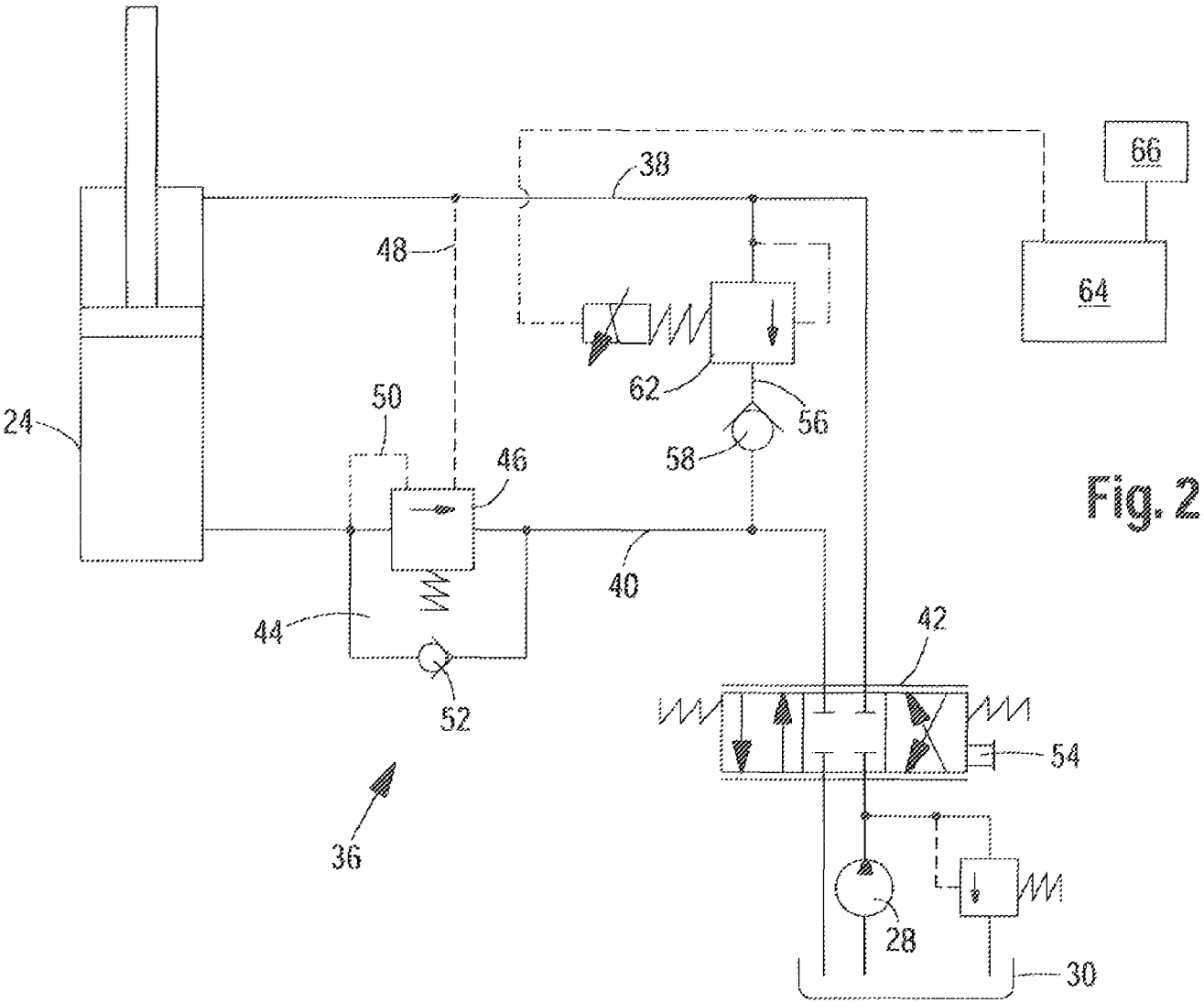
FIG. 2 is a schematic circuit diagram of a hydraulic arrangement.
Figure 3:
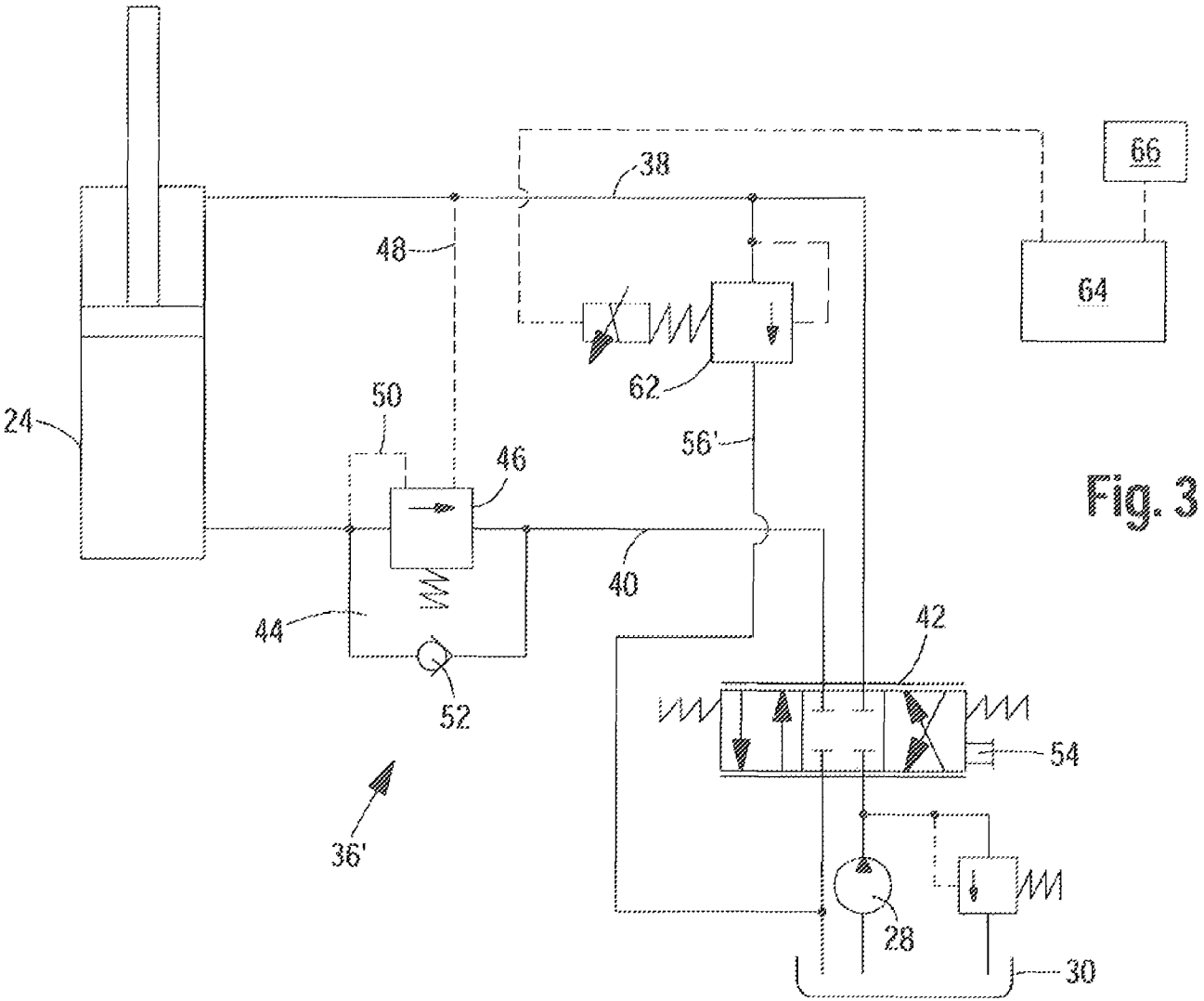
FIG. 3 is a schematic circuit diagram of an alternate hydraulic arrangement.

Referring now also to FIGS. 2 and 3, it can be seen that the loader 10 possesses a hydraulic source 28 and a hydraulic tank 30, which are arranged underneath the vehicle bodywork and serve the purpose of supplying the hydraulic components.

A mechanical operating device 34 arranged in the cab 32 serves the purpose of actuating the hydraulic components. The hydraulic components are illustrated substantially in FIG. 2.

A hydraulic arrangement 36 envisaged for the loader 10 is illustrated in FIG. 2. The hydraulic arrangement 36 comprises the hydraulic cylinder 24, and, should the need arise, the hydraulic cylinders (not illustrated) arranged for the telescoping of the extension arm and tilting of the loading implement. The hydraulic cylinder 24 is connected via a first supply line 38 and a second supply line 40 to a mechanically actuated control device 42, here shown as a closed center, four way, three position directional control valve, via which the connection of the supply lines 38, 40 to the hydraulic pump 28 and the hydraulic tank 30 can be produced. The control device 42 is mechanically connected to the operating device 34, for example via Bowden cables, so that displacement of the control device 42 and/or the valve gate of the control device 42 can be effected by moving the operating device 34.

A toad holding valve 44 is arranged in the supply line 40 associated with the chamber of the lifting side of the hydraulic cylinder 24. The load holding valve 44 comprises a pressure-limiting valve 46 capable of being opened in the direction of the control device 42, which pressure-limiting valve is arranged in the supply line 40 and Is capable of being opened in the direction of the control device 42, which pressure-limiting valve is arranged in the supply line 40 which is capable of being opened via control pressure contained in control pressure lines 48, 50, which are connected to both supply lines 38, 40, as well as a check valve 52 arranged in a bypass line and opening in the direction of the hydraulic cylinder 24. The load holding valve 44 serves to ensure that, in the event of a pipe fracture on the lifting side of the hydraulic cylinder 24, no hydraulic fluid is able to escape and the hydraulic cylinder 24 maintains its position.

The control device 42 comprises three gate positions, one for lifting, one for lowering and one more for holding the hydraulic cylinder. The control device 42 is configured as a mechanically switchable or mechanically actuated proportional valve and can be mechanically actuated or adjusted via an actuating device 54, the actuating device 54 being mechanically connected to the operating device 34.

The mechanically actuated control device 42 provides for the engagement or disengagement of the hydraulic pump 28 with or from the supply lines 38, 40. For example, an actuating lever present on the operating device 34 is pushed forward, which results in the actuation of the control device 42, and this is displaced into its lifting position and the hydraulic cylinder 24 is filled with hydraulic fluid on the lifting side, that is to say, it is extended. A corresponding actuation of the actuating lever in the opposite direction would cause the displacement of the control device 42 into the lowering position, whereupon the hydraulic cylinder 24 would be retracted and the extension arm 14 lowered.

Provided in the illustrative embodiment depicted in FIG. 2, is a connecting line 56, which extends between the two supply lines 38, 40. Arranged in the connecting line 58 is a check valve 58 closing in the direction of the supply line 38 on the piston rod side, which check valve prevents hydraulic fluid from the supply line 40 on the piston side from flowing into the supply line 38 on the piston rod side. Arranged in the connecting line 56 between the check valve 58 and the supply line 38 on the piston rod side Is an electro-hydraulic over pressure valve 82. The overpressure valve 62 is arranged in such a way that hydraulic fluid can flow from the supply line 38 on the piston rod side in the direction of the supply line 40 on the piston side. For this purpose, the electro-hydraulic overpressure valve 62 is connected to an electronic control unit 64. As soon as a pressure limit pressure is reached by the pressure building up in the supply line 38 on the piston rod side, the overpressure valve 82 opens, so that hydraulic fluid flows into the supply line on the piston side and from there into the hydraulic tank 30, with the result that the speed of displacement of the hydraulic cylinder 24 is reduced, because the volumetric flow rate of the hydraulic fluid present in the supply line 38 on the piston rod side is reduced. This means that the quantity of hydraulic fluid, which flows info the chamber of the hydraulic cylinder on the piston rod side, is reduced and, as a result, the actuation of the hydraulic cylinder 24, in this case retracting the hydraulic cylinder 24, is slowed down. Of course, the arrangement of the check valve 58 and the electro hydraulic overpressure valve 62 can be in the opposite sense, so that hydraulic fluid can flow from the supply line 40 on the piston side into the supply line 38 on the piston rod side. In this case, extension of the hydraulic cylinder 24 would then be slowed down.

Control of the overpressure valve 62 takes place through the electronic control unit 64, which for its part receives control signals from a bad case sensor 66. Depending on the load condition, the sensor 86 indicates a more or less critical load condition. As the critical load condition is approached, the control input transmitted by the electronic control unit 84 for adjusting the overpressure valve 82 is strengthened, which then causes the valve to be opened further, so that the discharge volumetric flow rate increases. The adjustment or the increase of the control input in this case preferably takes place proportionally to the signal provided by the sensor.

The sensor 66 is preferably arranged on the rear axle 18 of the loader 10. For example, the sensor 66 is configured as a strain gauge and registers or records the deflection of the rear axle 18. It is then possible to arrive at a conclusion in respect of the application and removal of the load on the rear axle 18 from the signal values for the deflection. If the load on the rear axle 18 were to reduce increasingly, this can point to the existence of a critical load condition, namely at the latest if a bad was no longer to be detected or indicated on the rear axle 18. In this case, the loader 10 begins to overturn. A similar approach Is conceivable for the front axle 16.

Illustrated in FIG. 3 is an alternate illustrative embodiment for a hydraulic arrangement 36', in which there is arranged, in place of the connecting line 56 from FIG. 2, a discharge line 56' in which the electro-hydraulic overpressure valve 62 is arranged. The discharge line 56' branches from the supply line 38 on the piston rod side and passes into the hydraulic tank 30. In this way, hydraulic fluid can flow directly from the supply line 38 on the piston rod side via the overpressure valve 62 into the hydraulic tank 30. Control of the overpressure valve in this case takes place in an analogous manner to the illustrative embodiment depicted in FIG. 2. No check valve 58 is provided in the hydraulic arrangement 36' depicted in FIG. 3, because no connection of the supply line 40 on the piston side to the discharge line 56' is present. In an analogous manner to the illustrative embodiment depicted in FIG. 2, only the contraction of the hydraulic cylinder 24 is slowed down in FIG. 3. As in the illustrative embodiment described in relation to FIG. 2, it is also possible in the illustrative embodiment depicted in FIG. 3 for the flow of hydraulic fluid to be provided from the supply line 40 on the piston side, and for the extension of the hydraulic cylinder 24 to be slowed down by this means. In this case, the discharge line 56' is connected to the supply line 40 on the piston side, in conjunction with which the control of the overpressure valve takes place in an analogous manner to the example depicted in FIG. 3.

The illustrative embodiments of the hydraulic arrangements 36, 36' depicted in FIGS. 2 and 3 provide a representative indication of the arrangement of only a single hydraulic cylinder 24. As mentioned above, further hydraulic cylinders (not illustrated) can be used in parallel, which cylinders are capable of actuation in the same way as an actuating device 34 and are also incorporated in the hydraulic arrangements 36, 36' of the kind depicted in FIGS. 2 and 3. Furthermore, as already mentioned, it is possible not only to restrict and/or to slow down the retraction and/or lowering of the hydraulic cylinder 24. It is naturally also conceivable to restrict and/or slow down the extension, as would be required, for example, in order to avoid the extension of the extension arm 14 in order to prevent overturning of the telescopic loader. In this case, for the illustrative embodiment in FIG. 2, the control pressure line 56, with which the lilting position of the control device 42 and with it the extension of the hydraulic cylinder 24 is actuated, would be provided with, or connected to, an electro-hydraulic overpressure valve 62. For the illustrative embodiment in FIG. 3, the supply line 40 of the piston side would be connected to a corresponding discharge line 56' with an electro-hydraulic overpressure valve 62.

Figure 4:
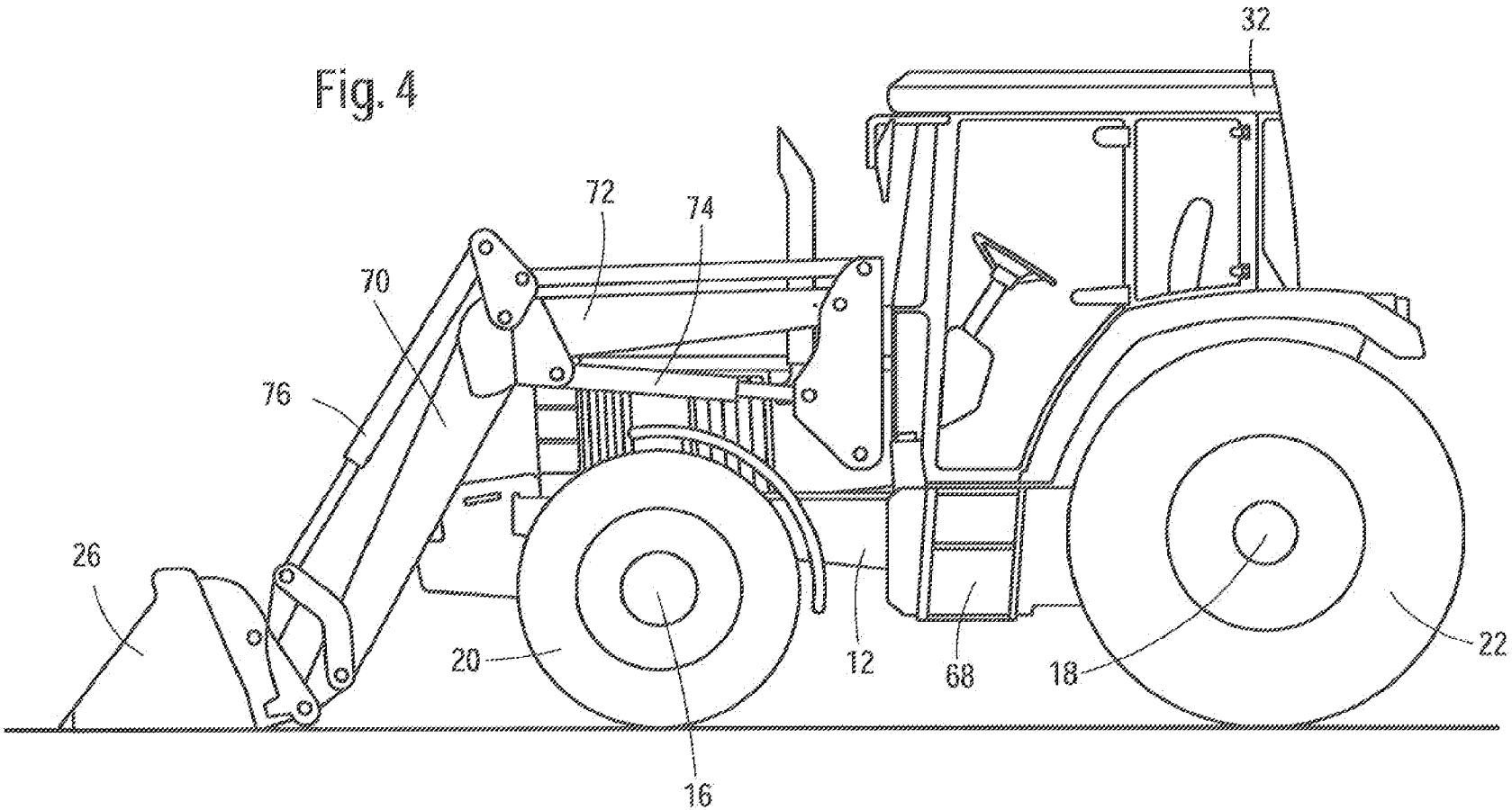
FIG. 4 is a schematic left side view of a loader exhibiting a front loader having a hydraulic arrangement according to FIG. 2 or 3.

FIG. 4 depicts a loader 10 in the form of a tractor 68 with a front loader 70 as a further illustrative embodiment, in conjunction with which the same reference designations are used for the same components of the loader 10, such as the frame 12, front axle 16, rear axle 18, wheels 20, 22, loading implement 26 and cab 32. In this case, the load arms 70, which are arranged to either side of the tractor 68, represent an extension arm, the actuation of which in specific situations and in the event of overloading can give rise to critical load conditions of the loader 10. The hydraulic cylinders 74 provided for the actuation of the load arms 70 and the hydraulic cylinders 78 provided for the actuation of the loader implement 26 are operated in this case in an analogous manner to the hydraulic arrangements 36, 36' depicted in FIGS. 2 and 3.

Having described the preferred embodiment, it will become apparent that various modifications can be made without departing from the scope of the invention as defined in the accompanying claims.

The invention claimed is:

1. In a loader including a frame supported on front and rear axles carrying front and rear sets of wheels, a hydraulically operated extension arm mounted to the frame for swinging vertically between lowered and raised positions, an extensible and retractable hydraulic cylinder coupled between said frame and said extension arm for selectively moving said arm between said lowered and raised positions, a first supply line coupled to a piston rod side of said hydraulic cylinder, a second supply line coupled to a piston side of said hydraulic cylinder, a pressurized hydraulic fluid source, a hydraulic fluid tank, at least one mechanically switchable control device coupled, on the one hand, to said first and second supply lines and coupled, on the other hand, to said fluid source and fluid tank and being selectively operable for controlling the flow of hydraulic fluid to and from said hydraulic cylinder, a load sensor located on said loader for monitoring a load condition on the loader and operable for creating an electrical load signal representing said load condition, and an electronic control unit coupled to said load sensor for receiving said electrical signal and comparing it with a critical load stored in memory in said electronic control unit and for generating a control signal representing a difference between said load signal and said critical load, the improvement comprising: a load holding valve including a pressure limiting valve located in said second supply line and normally preventing flow toward said control device from said hydraulic cylinder: first and second control pressure lines respectively connecting the rod and piston sides of said hydraulic cylinder to said pressure limiting valve such that the respective pressures therein act in a direction tending to open said pressure limiting valve; one of a connecting line or a discharge line having a first end coupled to said first supply line, with said connecting line having a second end coupled to said second supply line, and with said discharge line having a second end coupled directly to said tank; an electrically operable variable restriction device being coupled in said one of said connecting line or discharge line for establishing a variable restricted flow path away from said first supply line and including a proportional electrical controller connected for receiving said control signal from said electronic control unit and being operable in response to said control signal for gradually reducing a restriction afforded by said restricted flow path when said sensed load increases toward a value equal to said critical load.

2. The loader, as defined in claim 1, wherein said variable restriction device includes at least one electro-hydraulic overpressure valve connected so as to be subject to the pressure in said first supply line for urging said overpressure valve to an open position, with said overpressure valve further being connected for receiving said control signal from said electronic control unit for establishing a bias resisting opening, with said overpressure valve being located in said one of said connecting line or said discharge line, whereby said overpressure valve permits flow from said second supply line through said one of said connecting line or discharge line when in said open position.

3. The loader, as defined in claim 1, wherein said variable restriction device is located in said connecting line; and a check valve being located in said connecting line between said second supply line and said variable restriction device and blocking flow toward said first supply line.

4. The loader, as defined in claim 1, wherein said variable restriction device includes at least one electro-hydraulic overpressure valve connected for receiving said control signal from said electronic control unit and being located in said a discharge line.

5. The loader, as defined in claim 1, wherein said loader is configured as a telescopic loader.

6. The loader, as defined in claim 1, wherein said loader is configured as a front loader.

7. The loader, as defined in claim 1, wherein said load sensor is mounted on one of said front and rear axles of said loader.

* * * * *